United States Patent [19]

Taylor

[11] Patent Number: 4,497,252

[45] Date of Patent: Feb. 5, 1985

[54] PROXIMITY RESPONSIVE APPARATUS

[75] Inventor: Richard J. Taylor, London, England

[73] Assignee: EMI Limited, Hayes, England

[21] Appl. No.: 331,313

[22] Filed: Feb. 9, 1973

[30] Foreign Application Priority Data

Feb. 18, 1972 [GB] United Kingdom ..... 7726/72

[51] Int. Cl.[3] ..... F42C 13/04

[52] U.S. Cl. ..... 102/214; 102/213

[58] Field of Search ..... 102/70.2 P, 211, 213, 102/214; 343/7 PF, 7 ED, 112 CA

[56] References Cited

U.S. PATENT DOCUMENTS 3,670,652 6/1972 Ziemba ..... 102/70.2 P 3,732,564 5/1973 Kuck et al. ..... 102/70.2 P 3,745,573 7/1973 Dick ..... 102/70.2 P 3,747,531 7/1973 Powell ..... 102/70.2 P

*Primary Examiner*—Charles T. Jordan

*Attorney, Agent, or Firm*—Fleit, Jacobson, Cohn & Price

[57] ABSTRACT

Proximity responsive apparatus capable of being used, for example, as a fuzing device for a bomb includes means for generating and emitting pulses of energy which conform to a predetermined time varying waveform. Reflected energy is sampled at two or more spaced instants in time, and the sampling instants are chosen in accordance with the required range of operation of the apparatus and also the shape of said waveform. The samples are compared and the result of the comparison is a signal used to control the fuzing of the bomb.

7 Claims, 5 Drawing Figures

PROXIMITY RESPONSIVE APPARATUS

The present invention relates to proximity responsive apparatus, and it relates especially, although not exclusively, to such apparatus as may be employed as a proximity fuze for a bomb.

Figure 1:
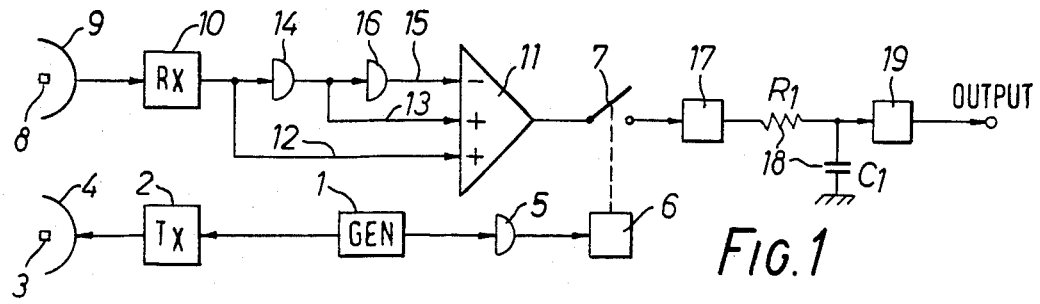
Figure 2:
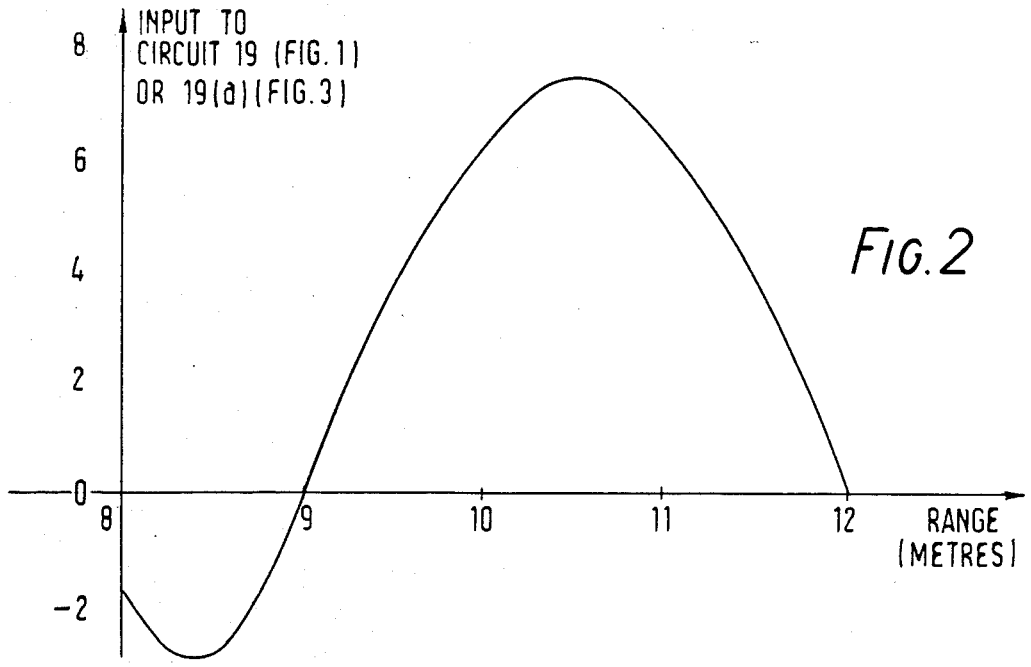
Figure 3:
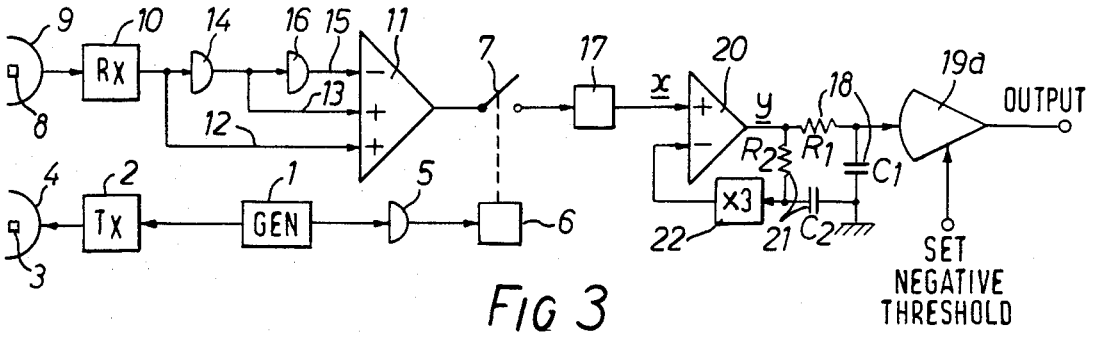
Figure 4:
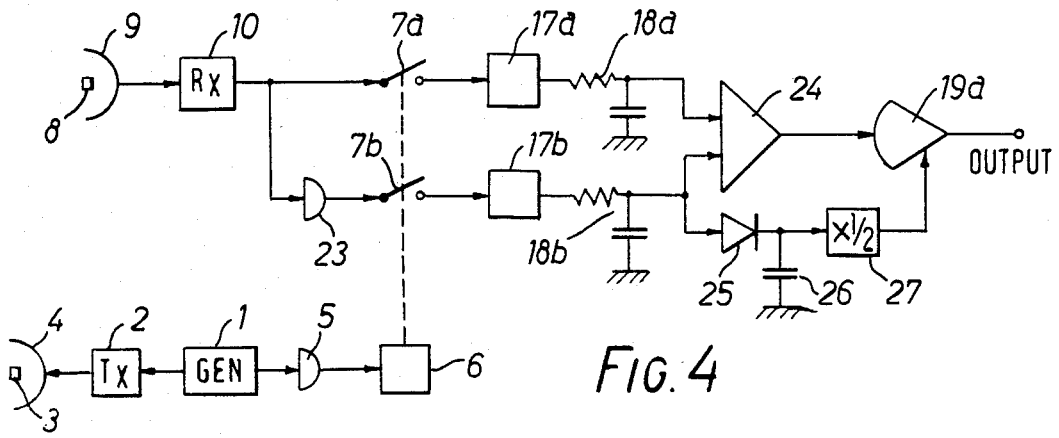
Figure 5:
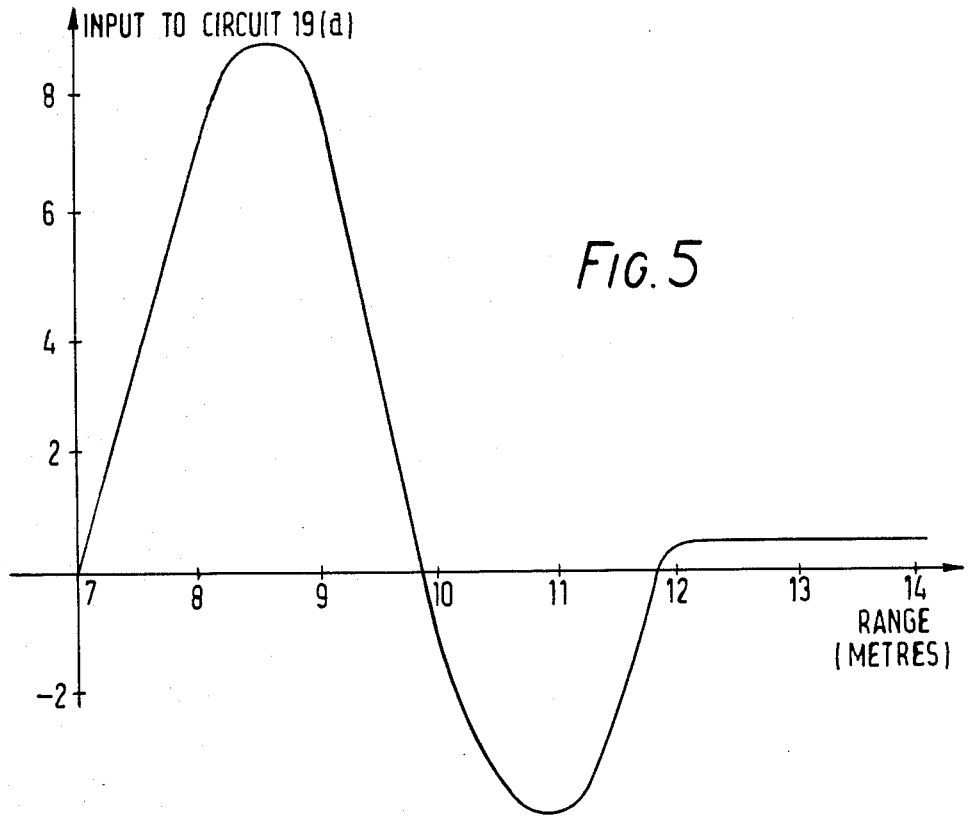

In order that the invention may be clearly understood and readily carried into effect, the same will now be described by way of example only, in terms of two specific embodiments thereof with reference to the accompanying drawings, of which:

FIG. 1 shows, in block diagrammatic form, apparatus in accordance with one example of the invention employed as a proximity fuze for a bomb, FIG. 2 is a graph indicative of the operation of the apparatus of FIG. 1, FIG. 3 shows in block diagrammatic form, modified apparatus similar to that shown in FIG. 1, FIG. 4 shows, in block diagrammatic form, apparatus in accordance with another example of the invention, and FIG. 5 is a graph indicative of the operation of the apparatus shown in FIG. 4.

As has been mentioned above, it is necessary that the transmitted pulse follows a time varying waveform of predetermined shape and that the sampling instants are chosen in relation to this shape. In this example, the shape is chosen to be a half sinusoid of duration 22 ns. Sin $\theta$ evaluated at $\theta=100°$, 140° and 160° gives 0.985, 0.643 and 0.342 respectively. It will be observed that the sum of the latter two values equals the first value. Thus, in a proximity fuze which is desired to provide a signal when a bomb is at a predetermined distance a from a target (corresponding to a double transit time t) the signals received by a receiver, co-sited with the transmitter, are sampled at instants corresponding to $t+100°$, $t+140°$ and $t+160°$ and the result of the addition of the latter two samples is subtracted from the first sample; the overall computation providing a zero output when a target is situated at distance a from the transmitter.

In the present example, a is nine meters and therefore t is approximately 60 ns. Moreover for a half sinusoid pulse of 22 ns duration, the 100°, 140° and 160° points occur at 12.2, 17.1 and 19.6 ns respectively from the start of the pulse. Thus, in this example the output of the receiver is sampled at 72.2, 77.1 and 79.6 ns respectively from the start of the transmitted pulse.

Referring now to FIG. 1, the half-sinusoid pulse is generated in a generator 1 and is repeated at a pulse repetition frequency of, for example 70 KHz. Generator 1 is coupled to a transmitter 2 and thence to a radiating device which, in this example, comprises an infra-red emitting element 3 placed at the focus of an optical system, which is shown schematically as a paraboloidal reflector 4. The pulses generated by generator 1 are also applied, via a delay element 5, having a delay corresponding to the longest of the three periods mentioned above (i.e. 79.6 ns), to an impulse generator 6 which is effective to produce an impulse which operates a sampling device (shown schematically as a simple switch 7) in the receiving circuit.

The receiving circuit comprises an infra-red detecting element 8, at the focus of an optical system shown schematically as a paraboloidal reflector 9. The element 8 feeds a receiver 10 which is coupled to a summing amplifier 11 via three paths; path 12 which is a direct path; path 13 which includes a 2.5 ns delay element 14 and path 15 which includes the delay element 14 and also a 4.9 ns delay element 16. The output of amplifier 11 is passed via the switch 7 to a hold circuit 17 and thence via an integrator network 18, comprising a resistor R1 and a capacitor C1, to a zero crossing detector 19. Detector 19 provides an output signal when the signal applied to its input passes through zero.

FIG. 2 is a graph showing the envelope of the input signal applied to detector 19 versus target range with respect to the transmitter.

The apparatus shown in FIG. 1 performs a reduction of noise as compared with a signal since any sample taken via switch 7 will contain a signal component and a noise component. Assuming that the noise component from one sample is statistically independent of that from any other sample, the integrating network $R_1C_1$ will cause noise to add in proportion to its root mean square value, whereas the signal components will add directly. It has been found convenient to select the time constant of $R_1C_1$ to be $33\frac{1}{3}$ ms.

The apparatus shown in FIG. 1 has been found to exhibit good performance under conditions of poor visibility, e.g. in fog, due to the fact that although the target is obscured by the fog, the presence of the target modifies the reflected energy as compared with the energy which would have been reflected by fog alone. This modification causes the sinusoidal transmitted waveform sin $\theta$ to be returned as a waveform of the kind $\frac{1}{2}(1+\cos\theta)$ and it has been found that, if the sampling as described above is carried out on this waveform, although there is a small offset in the zero crossing point compared with that shown in FIG. 2, this is within acceptable limits for reliable fuzing.

The zero crossing detector 19 could be replaced by a negative threshold circuit. This is a preferable alternative since, when using a zero crossing detector, erroneous triggering could occur in the absence of a received signal. The curve of FIG. 2 can be effectively shifted to the right, so that the negative-going peak occurs at the required proximity of fuzing (i.e. 9 meters in this example), by increasing the delay imparted by delay element 5.

Modifications to the circuit shown in FIG. 1 may be made in order to allow for the fact that a transmission and reception of radiation along a single, stationary beam may not, in some circumstances, provide a wide enough field of view to permit location of the target. Either multiple stationary beams or a single beam rotated about the axis of the fuze can be employed in such circumstances. In the present example it will be assumed that four stationary beams are used, although the invention is equally applicable to apparatus including more or less than four stationary beams or a rotating beam.

The four beams could be made part of four separate fuzes, but this is not an economic proposition. In practice, the four beams are coupled to a common receiver and transmitter. Thus, in the worst case, under operation in fog, the target might appear in only one of the four beams while the rest only illuminate in fog. In these circumstances, the above mentioned modification of the fog return by the presence of the target does not occur, but it has been discovered that the net return from the fog is abruptly attenuated by 25%. This permits the target to be detected, and it has been found that, under these conditions, the basic shape of FIG. 2 is obtained except that the positive and negative excursions thereof are each reduced to about 25% of the respective values shown in FIG. 2, and a vertical D.C. offset is introduced. This offset is equal to three-quarters of the output from circuit 18 for long range returns (i.e. returns obtained before the target has come within range of the apparatus). This offset can therefore be removed by storing the long range returns and subtracting 75% of their value from the output of circuit 18.

Referring now to FIG. 3, which shows the basic apparatus of FIG. 1 (using the same reference numerals for identical items) modified to effect the above mentioned subtraction. Between hold circuit 17 and the integrating network 18 there is provided a subtracting amplifier 20 which has an input voltage x and an output voltage y. The output voltage y is fed back to the subtracting input of amplifier 20 via an integrating network 21 comprising a resistor R2 and a capacitor C2 and a trebling circuit 22, so that the equation governing the subtraction is $y=x-3y$, or $y=x/4$, which is the desired result. C2 is arranged to have a sufficiently long time constant to ensure that changes to the output of the apparatus, created by the arrival of the target within its range, have substantially no effect on the voltage across it. Zero crossing detector 19 of FIG. 1 has been replaced by a comparison circuit 19*a* which compares its input signals with a negative threshold.

The apparatus described so far has employed three samples to recognise the shape of reflected pulses. In an alternative embodiment of apparatus in accordance with the invention the slope of the reflected pulses, at the point corresponding to the triggering proximity, is monitored. This embodiment is preferred to the embodiments described with reference to FIGS. 1 and 3 since, as will become clear later, the apparatus in accordance with the embodiment is capable of ignoring the presence of, for example, foliage in the vicinity of a target.

Referring now to FIG. 4, in which components common to FIGS. 1 and 3 are allocated the same reference numerals, the transmitter section remains unchanged and, as before emits a 22 ns half sinusoid pulse. However the receiving circuit is arranged to take two samples, at 75 and 82 ns respectively from the start of the transmitted pulse. The sample taken at 82 ns is subtracted from that taken at 75 ns and hence a measure of the slope is obtained. The sampling instants 75 ns and 82 ns were chosen to ensure that the apparatus produced a peak response at a target range of 9 meters; other instants could, however, be chosen.

The output of receiver 10 is fed direct to a switch 7*a* and via the 7ns delay element 23 to a second switch 7*b*. Switches 7*a* and 7*b* are operated in synchronism by impulse generator 6, the delay imparted by element 5 now being 82 ns. Each switch 7*a*, 7*b* feeds a respective hold circuit 17*a*, 17*b* and thence via respective integrating networks 18*a*, 18*b* to the two inputs of a difference amplifier 24. The output of amplifier 24 is fed to a threshold circuit 19*a*.

FIG. 5 shows the signal fed to circuit 19*a* in conditions of good visibility. It will be seen that the peak positive excursion of the waveform is a good indication that the target is at the fuzing range.

As previously mentioned, the apparatus shown in FIG. 4 is capable of providing accurate fuzing when a bomb is falling through foliage as well as operating satisfactorily in conditions of poor visibility. Such foliage penetration is possible since the top of most varieties of trees is not an abrupt change from leaf to sky in a single plane but comprises a multitude of leaves and branches, large and small, extending from the depth of the tree to varying heights.

If an infinitely thin pulse is radiated from the transmitter towards the tree in a pencil beam, the energy returned to the receiver will not be in the form of the transmitted impulse (as in the case when the transmitted pulse strikes solid ground and returns) but will consist of a series of impulses of different amplitudes and delays depending on the amount of foliage of any given range. In the limit, for a sufficient number of returns, this series of impulses merges into a continuation curve.

For the purpose of explanation, the continuous curve, or distribution of power reflected from different ranges is assumed to be a Rayleigh distribution, and "target density" $\rho$ has arbitrarily been defined as the difference between the ranges at which 10% and 90% respectively of the total power has been received. Thus it will be appreciated that "hard" targets (e.g. solid ground, etc) will exhibit small values of $\rho$ and "soft" targets (such as foliage) will exhibit large values of $\rho$.

By convoluting the impulse response for targets of different densities $\rho$ at nine meters range with the 22 ns half sine wave pulse from the transmitter, it can be shown that until the width of the Rayleigh impulse becomes comparable with that of the half sine pulse, the width of the impulse response has little effect on the received waveform and the shape equals that of the half sine pulse. For target densities $\rho$ greater then 2 m the shape of the received pulse is governed by the shape of the Rayleigh curve, as now the target impulse response is wider than the half sine. In consequence of these considerations, the slope of the received waveform as measured by the apparatus of FIG. 4 will be higher from a 'hard' target than from a 'soft' one.

Therefore, by choosing an appropriate slope threshold, the fuze can be made to discriminate between hard and soft targets. However, the apparatus of FIG. 4, as described so far could be confused by varying target reflectivities, since a certain output from the amplifier 24 could either be caused by a high reflectivity, soft target or a low reflectivity, hard target. This problem is overcome by normalizing the output of amplifier 24 to make it independent of reflectivity. If the fuze is to be able to penetrate foliage, independent of reflectivity, the actual parameter that must be monitored is not just the slope of the convolved impulse response, but the ratio of that slope to the peak amplitude seen at the stand off range (i.e. the fuzing range a).

To this aim (referring to FIG. 4) the output of integrator 18*b* (i.e. the sample taken at 75 ns) is peak rectified and stored by means of rectifier 25 and capacitor 26. This signal represents the peak amplitude of the signal return measured at the fuzing range. In order that the signal stored on capacitor 26 may be used to normalize the output of the amplifier 24, a conventional arrangement would be to divide the output signal from 24 by the peak rectified signal and then feed the result of the division to a circuit which has a fixed threshold. However, as analogue dividers are expensive and relatively unstable devices, a preferable alternative, as shown in FIG. 4, is to apply a fixed fraction of the peak rectified signal as a variable threshold level to circuit 19*a*. In this way, as the amplitude of the return increases so the threshold moves up to compensate. One half of the rectified signal was found in practice to be optimum setting for the threshold, thus the signal stored on capacitor 26 is divided by two in a circuit 27 and the result of the division applied as a variable threshold control signal to circuit 19*a*.

Although the invention has been described in relation to proximity fuzes, it is not limited to such application; it could also be used, for example, for indicating the proximity between motor vehicles, or ships. Moreover the invention could be used for detecting human beings concealed in, say, undergrowth because of its ability to ignore foliage and the like.

What I claim is:

1. Proximity responsive apparatus comprising generating means for generating a pulse of energy, transmitter means for transmitting said pulse, receiver means for receiving said pulse after reflection from a target, sampling means coupled to said receiver means for sampling the amplitude of a received pulse, as received at different times, over a period of shorter duration than the pulse, comparing means coupled to said sampling means for comparing the amplitudes of the samples and output means coupled to said comparing means and adapted to respond to a predetermined relationship between said amplitudes by generating an electrical output signal.

2. Apparatus according to claim 1 wherein said comparing means includes a differencing amplifier and said sampling means includes first and second switch means, respective paths through which said received pulse is applied to both switch means, relative delay means arranged in said paths, switching means for simultaneously operating said first and second switch means, and said comparing means includes a differencing amplifier connected to said first and second switch means, the switching means being arranged to enable said switch means momentarily to effect said sampling.

3. Apparatus according to claim 2 wherein said sampling means includes delay means connected from said generating means to said switching means to effect said sampling a predetermined interval after transmission of said pulse.

4. Apparatus according to claim 1 wherein said comparing means includes a three-input amplifer means and said sampling means comprises three paths, each connected to receive said received pulse, and to convey it to a respective input of said amplifier means, delay means for delaying the pulse to a different extent in each of said paths, switch means connected between the output of said amplifier means and said output means and switching means for enabling said switch means to effect said sampling.

5. Apparatus according to claim 4 wherein said sampling means includes delay means connected from said generating means to said switching means to effect said sampling a predetermined interval after transmission of said pulse.

6. Apparatus according to claim 1 wherein said output means includes an amplitude threshold detector.

7. Apparatus according to claim 1 wherein said output means includes a zero crossing detector.

* * * * *